US009249583B2

(12) United States Patent
Wise et al.

(10) Patent No.: US 9,249,583 B2
(45) Date of Patent: Feb. 2, 2016

(54) EASY TO INSTALL AND REMOVE TILE SYSTEM

(71) Applicant: ARMSTRONG WORLD INDUSTRIES, INC., Lancaster, PA (US)

(72) Inventors: Lynn M. Wise, Lancaster, PA (US); James F. Mathis, Lancaster, PA (US); Kean M. Anspach, Quarryville, PA (US); John R. Eshbach, Jr., Mount Joy, PA (US); Michael E. Buckwalter, New Providence, PA (US); Charles H. Hines, Columbia, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 13/679,742

(22) Filed: Nov. 16, 2012

(65) Prior Publication Data

US 2013/0067843 A1 Mar. 21, 2013

Related U.S. Application Data

(63) Continuation of application No. 11/643,409, filed on Dec. 21, 2006, now Pat. No. 8,322,100.

(51) Int. Cl.
*E04F 15/10* (2006.01)
*E04F 21/22* (2006.01)

(52) U.S. Cl.
CPC ..... *E04F 15/10* (2013.01); *E04F 21/22* (2013.01)

(58) Field of Classification Search
CPC ..... E04F 15/10; E04F 21/20; E04F 21/22; E04F 15/02155; E04F 15/0215; E04F 15/022
USPC ..... 52/295, 384, 385, 389, 390, 391, 403.1, 52/408, 409
See application file for complete search history.

(56) References Cited

U.S. PATENT DOCUMENTS 2,852,932 A * 9/1958 Cable ..... E04F 15/08 156/293
4,694,627 A * 9/1987 Omholt ..... E04F 15/22 52/390
4,744,194 A * 5/1988 Yasuyoshi ..... E04F 15/02458 52/126.6
4,761,926 A * 8/1988 Rea ..... E04F 15/02005 428/131
5,447,004 A * 9/1995 Vrnak ..... E04F 21/22 52/387
5,635,266 A * 6/1997 Quinn ..... B29C 67/007 156/304.6
5,806,270 A * 9/1998 Solano ..... E04F 15/02 52/181
5,950,319 A * 9/1999 Harris ..... E04F 21/04 33/1 B
6,427,395 B1 * 8/2002 Elsasser ..... E01C 5/20 114/263
6,543,196 B1 * 4/2003 Gonzales ..... 52/386

(Continued)

OTHER PUBLICATIONS

Post-Industrial and Post-Consumer Vinyl Reclaim—Principia Partners, Jul. 1999.*

*Primary Examiner* — Brian Glessner
*Assistant Examiner* — Adam Barlow
(74) *Attorney, Agent, or Firm* — Michael U. Lee

(57) ABSTRACT

An easy-to-install and remove flooring system comprises three components: 1) a plurality of rolled-out liners, 2) a plurality of tiles, particularly resilient tiles, and 3) an adhesive adhering the tile to the liner. A grid pattern matching the size of the tiles is printed on the liner to enable easy centering and balancing of the tile in the room. The edge portions of adjacent liners are adjacent or overlapped. At least some of the tiles are adhered to two of the liners.

18 Claims, 3 Drawing Sheets

(56) References Cited

U.S. PATENT DOCUMENTS 6,797,353 B1 * 9/2004 Pacione ..... A47G 27/0293 428/100
6,834,438 B1 * 12/2004 Heister ..... E04F 21/0076 33/1 B
7,827,751 B2 * 11/2010 Plante ..... B23B 3/02 52/403.1
2004/0147663 A1 * 7/2004 Silvers ..... C09J 121/00 524/501
2007/0202266 A1 * 8/2007 Bober ..... 427/407.1

* cited by examiner

EASY TO INSTALL AND REMOVE TILE SYSTEM

CROSS-REFERENCE TO RELATED APPLICATIONS

The present application is a continuation of U.S. application Ser. No. 11/643,409, now allowed, filed Dec. 21, 2006, which is hereby incorporated by reference in its entirety.

FIELD OF THE INVENTION

The present invention relates generally to the field of flooring including tiles and more particularly to a flooring system that enables the tiles to be easily installed and removed. Still more particularly the present invention relates to resilient tiles and a flooring system comprising a plurality of tiles, a plurality of liners having a grid pattern printed thereon and adhesive to adhere the tiles to the liners.

BACKGROUND OF THE INVENTION

The floor replacement cycle for resilient flooring tile is long because among other reasons residential resilient tile is often difficult to remove and replace. The removability of fully adhered tile varies—sometimes it comes up with great difficulty, a small piece at a time—at best tile is removed with moderate difficulty in larger pieces or entire tile.

Further, residential resilient tile can be difficult to repair. Repair usually involves removing the tile in multiple pieces, scraping the floor, and respreading adhesive.

Also, residential tile can be difficult to recycle, since it usually comes up in pieces. These pieces are not easily collected and contained for shipping to a recycling plant. Additionally, as small pieces they are not easily identified as safely recyclable tile, possibly being non-vinyl tile or tile containing hazardous materials. The residential tile to be recycled may include an underlayment comprising materials not normally used to make tile.

With prior art residential tile, replacing the tile that has been removed requires additional subfloor preparation. This usually involves manual adhesive scraping, patching, and/or the installation of ¼" plywood.

Another disadvantage of prior art resilient tile is that it is not easily customizable or themed.

An issue for the average do-it-yourselfer is that planning the tile job can be confusing. It may be difficult for the average homeowner to properly center and balance the tile in the room. Also, positioning and centering a rolled-out underlayment on the floor can be difficult if the room center marks are covered by an opaque underlayment.

Further, water can get trapped under the tile in wet areas. This is especially true when using adhesive tabs, i.e. discontinuous adhesive, to install the tile.

In order to make a floor that floats, the flooring pieces must be attached to each other. Inexpensive tile is usually thin and weak and not easily locked together via the edges. Tiles that are not affixed to the subfloor with full-spread glue can be prone to shifting due to foot pivoting and due to furniture movement.

Another issue with a floating floor is that installing tile on a floating underlayment on plywood or on an existing floor can lead to fatigue failure under chair wheels due to repeated flexing of the tile. Also, fatigue failure due to repeated flexing of the tile under chair wheels is enabled by and manifested at the tile joints. Further, dragging appliances over floating tile system can result in the tile or underlayment being torn.

Changing seasons cause the subfloor in typical residential construction to move with changing moisture levels. This movement can cause flooring to buckle due to shrinkage of the subfloor or tearing due to expansion of the subfloor.

SUMMARY OF THE INVENTION

Floor replacement cycle time can be shortened by making the flooring easier to install and remove. Ease of tile installation and removal can be enabled by installing the tile on a separate, easy to install liner, which is floating (not connected) to the existing floor. Removal entails removal of liner and tile together. Optionally, the liner can be adhered to the existing floor.

Ease of installation and removal is also increased by using an adhesive system that allows tile to be pried up and a new tile to be slipped into place, such as adhesive tabs of proper size or a spray adhesive or a tile with pre-applied adhesive.

To identify recyclable tiles, the liner can be printed with identification including a recycling stamp of approval. Since the tile will be removed in one piece, it can be separately identified as recyclable. Recycling is made simple by the use of rigid vinyl film as the liner, since it is the same rigid vinyl currently used on the surface of the tile.

The use of a rolled out liner allows the tile job to be removed with the previous subflooring condition unchanged from the original. The ability to pry up individual tiles allows the floor to be customized, e.g. as the season changes, or as a person's interest changes. Accent tiles depicting skiing in the winter can be changed to flowers when spring arrives. Philadelphia Eagles tiles can be changed to the Indianapolis Colts.

A printed grid liner turns the mental challenge of centering and balancing the flooring in a room to a visual picture. The tile locations and sizes at the perimeter of the room are visually seen during this layout process. By using a clear or translucent liner, positioning and centering of the rolled-out liner on the room center marks is facilitated.

Water can be deterred from entry under the tiles by seam sealing the tile, particularly beveled tile with existing resilient floor seam sealers. Further, the liner locks the tile pieces together and the tile pieces lock the liner pieces together.

Fatigue failure is deterred by using a liner with a high modulus and tensile strength to hold the installation together. Both plastisol saturated glass and rigid vinyl film fit this description. A high modulus, low indentation liner can reduce the degree of flexing. Also, higher binder tile (LVT) can reduce the damage from flexing.

Seam sealing the tile reduces or eliminates the tile joint as the point of failure and improves the performance of floating tile under chair wheels. Tearing of the tile or underlayment when an appliance is dragged over the tile is reduced or eliminated by using a high modulus, high tear strength liner. A high shear strength adhesive also addresses this problem, as well as a thicker, more substantial tile.

Tile installed on a stable liner has minimal buckling if the tile itself is buckle resistant. Tile installed on a stable liner has minimal tearing or gapping if the liner has high modulus and tensile strength.

The problems set forth above are solved by an easy-to-install and remove system that comprises three components: 1) a plurality of rolled-out, floating liners, 2) a plurality of tiles, particularly resilient tiles, and 3) an adhesive adhering the tile to the liner.

DETAILED DESCRIPTION OF THE INVENTION

Figure 1:
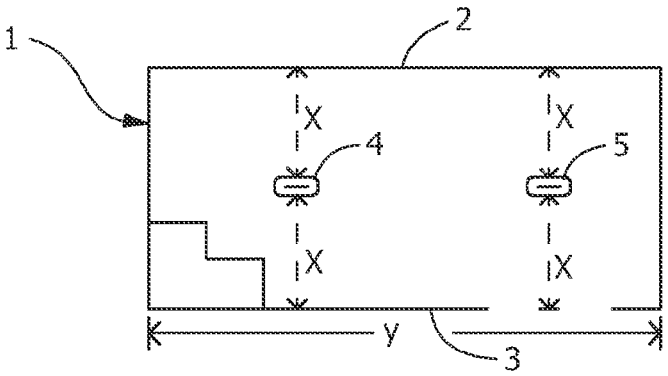
FIGS. 1 to 7 are schematic representations showing installation steps of the present installation method.

The installation of the system involves rolling out the liner, using the printed grid as a centering aid. First the center run of liner is rolled out then side runs of liner are rolled out to reach the wall. Next adhesive dots are applied to each corner of the tile, or adhesive is sprayed over the selected liner area or tile and allowed to dry. The tile is then laid onto the grid.

Individual tiles can be replaced by prying with a knife blade in a corner or edge of the tile and slowly prying up the tile, continuing to pull by hand as soon as the corner can be gripped. Then a new tile can be installed in its place.

Removal of the entire installation involves pulling up the tile/liner starting at a corner or edge, cutting the liner at the tile perimeter, and restacking the tile for disposal/recycle.

The liner may be a 32" wide, 4 mil clear, matt finish, rigid vinyl film. To enable positioning and centering the tile the liner should have grid lines the size of the tile to be installed printed on the liner. In one embodiment, a row of squares are centered longitudinally on the liner and two rows of half tile sized rectangles are printed adjacent the edges of the liner. The width of the liner can be a multiple of the tile width, with the row of tiles centered or the seam between the rows of tiles centered, in which case the liners are laid with the edges of adjacent liners adjacent. If the width of the liners is somewhat greater than a multiple of the tile width, the edge portions of adjacent liners are overlapped when the liners are laid.

The modulus of elasticity, tensile strength, grid layout, and moisture resistance of the film are important to the proper functioning of the liner during installation and afterwards. The liner should be stiff enough to reduce the degree of flexing and deter buckling.

In one embodiment, the tiles are 16"×16"×0.125" modular vinyl tile. The adhesive may be adhesive dots applied to each of the corners of the tile, or pressure sensitive adhesive, or a spray adhesive applied to the tile or liner. The tiles can have other dimensions, such as a 12"×12" tile or 18"×18" tile or be self-adhering Place'n'Press tile of any size. The tile can be of different shapes such as rectangles, triangles, parallelograms. Different tile compositions can include non-PVC tile and liner, or any tile with a degree of conformability. The concept can likely be used with a variety of adhesive types including full adhesive on the back of the tile, dots of various kinds of adhesive, and spray adhesive.

The liner can either float on the substrate or be adhered to the substrate with an adhesive or other means that does not damage the substrate and is easy to remove. The tile can be laid over the entire substrate or form an island on the substrate. If an island is formed, it is preferred that the tile overlying the edge of the liner extend beyond the edge of the liner and is adhered to the substrate.

Olsen Stiffness values are obtained on a Tinius Olsen Stiffness Tester with a range of 0 to 6 inch-pounds or 0 to 50 inch-pounds depending on the sample stiffness. The protocol described in ASTM D-747 was followed to measure the values with the exception that the values reported were obtained at an angle of 20 degrees and sample run on the 50 in-pound machine were 2" wide as opposed to 1" wide. The stiffness test is a measure of the force in inch-pounds needed to bend the material 20 degrees.

Olsen stiffness at 73.4 degrees F., 5 degree, 2 inch width, 1 inch span of no greater than 10 in-lb yields a tile that will conform sufficiently to the substrate on which it is laid. Preferably, the Olsen stiffness is no greater than 5 in-lb.

The Liner Specification for one embodiment of the tile, in which the liner is 36" wide allowing for a 4" overlap on each edge with 16" tile, is set forth in Table I below:

| | Thin, non-glass option | Glass option |
|---|---|---|
| Composition | rigid vinyl film | vinyl plastisol saturated glass scrim |
| Thickness | 0.0025" to 0.008" prefer 0.004" +/− 0.0005" | 0.025" +/− 0.003" or thinner if all other properties can be met. |
| Width | 36" +/− 0.030" | 36" +/− 0.030" |
| Modulus<br>Prefer Thickness times Modulus = 400 to 1000 lb/in | 200,000 psi minimum | 40,000 psi minimum |
| Yield Load | 5 lbs/inch minimum, prefer 14 lbs/inch minimum | 5 lbs/inch minimum, prefer 14 lbs/inch minimum |
| Gloss - 60 degree | 20-40 preferred - full gloss is acceptable | |
| Resistance to Moisture, Immersion Test | growth 0.3% maximum, prefer 0.1% maximum, absorption 0.1% maximum, preferred absorption up to 5% acceptable | growth 0.3% maximum, prefer 0.1% maximum |
| Dimensional Stability, 6 weeks @ 115 degrees F. | 0.3% change maximum, prefer 0.1% change maximum | 0.3% change maximum, prefer 0.1% change maximum |
| Camber | Ten meters of material cut from a roll and laid on a flat, smooth surface shall lay flat overall, with minimal puckering and baggy edge effect. Prefer | Ten meters of material cut from a roll and laid on a flat, smooth surface shall lay flat overall, with minimal puckering and baggy edge effect. Prefer |

-continued

| | Thin, non-glass option | Glass option |
|---|---|---|
| | vary no more than 15 mm from a straight line, with overlap may vary 150 mm, without overlap may vary 40 mm. | vary no more than 15 mm from a straight line, with overlap may vary 150 mm, without overlap may vary 40 mm. |
| Plastisol (Glass Option Only) | | Minimal migration, butyl benzyl phthalate (BBP) preferred plasticizer. |

The liner can also be formed from other materials, such as PET, PETG or Mylar. PETG can be successfully recycled into vinyl tile. Polyethylene likely cannot be recycled into vinyl tile.

Installation

The tile installation method provides an easy do-it-yourself system for consumers to install their favorite tile patterns. It takes the guesswork out of planning the tile layout and allows for a durable installation without the use of messy adhesives that can damage existing flooring. If desired, it can be easily removed or replaced as fashion and room use needs change. The installation method with adhesive tabs is not intended for bathrooms, laundries and other places where surface water and spills are likely to occur on a regular basis. The use of spray adhesive, in place of the adhesive tabs, provides added protection against surface water penetration.

Materials Needed:

Modular tile, Layout grid liner, Adhesive tabs, and Tape measure, pencil, hammer, pry bar, saw, household transparent tape, utility knife, scissors, carpenter's square or straight edge, and some cardboard or craft paper if a pattern needs to be made to fit to an irregular shaped object.

Preparation:

Remove furniture and appliances from the room. The tile can be fit directly to existing baseboard and trim moldings, however removing the baseboard molding and replacing it after the tile is in place will make the perimeter fitting much easier. Undercut doorframes (optional) to allow the tile to slip underneath and make fitting tiles around doorframes easier. Use a tile and hand saw, as known in the art. The tile is laid adjacent the doorframe and the saw is positioned with the blade resting on the surface of the tile with the teeth adjacent the doorframe and the handle of the saw extending past the edge of the tile. With the saw in this position, the doorframe is cut to remove the lower portion and permit the tile to be slid under the door frame.

All subfloors must be smooth, flat, clean and dry. Irregularities in the subfloor can telegraph through to the tile. Damaged areas in the subfloor should be repaired to create a structurally sound and firm base.

Suitable Substrates:

Old Vinyl Flooring: Must be a single layer and not be cushioned-backed or foam-backed. The vinyl must be firmly bonded. Loose vinyl, gapped seams, cuts, tears, rips or other damage need to be repaired.

Wood Floors: Must be structurally sound, meet applicable building codes and show minimal deflection. The tile can go over most types of wood subfloors and underlayments except for particleboard. Loose vinyl, gapped seams, cuts, tears, rips or other damage need to be repaired.

Concrete/Ceramic/Terrazzo/Marble:

Must be clean, dry and dust-free. Cracks, unevenness and other damage need to be repaired. If installing over ceramic, terrazzo, or marble tile, the ceramic, terrazzo or marble tile must be firmly bonded.

Do Not Install Over:

Carpet, Existing cushioned (foam-backed) vinyl flooring, or Existing resilient tile floors that are on or below grade.

The layout grid liner serves several purposes. It is an aid to planning the layout in the room and "balancing" the installation to avoid small pieces of tile at the perimeter walls. It protects the existing floor surfaces from damage and when it is decided to change flooring, makes removal and replacement much easier.

The layout grid is only to be used as an aid. After starting to lay tile on top of the grid (as described in succeeding steps) each tile must butt neatly and squarely to adjoining the tile, even if the tile edges start to wander slightly from the grid-lines.

Step 1 (FIG. 1). In most rooms 1, there will be one or two walls 2 and 3 that are relatively longer and straighter than other walls. In these instructions such walls are referred to as prominent walls. Find the midpoint of the room between the two most prominent parallel walls 2 and 3 and place a small piece of masking tape 4 and 5 with a pencil mark at two spaced locations.

Figure 2:
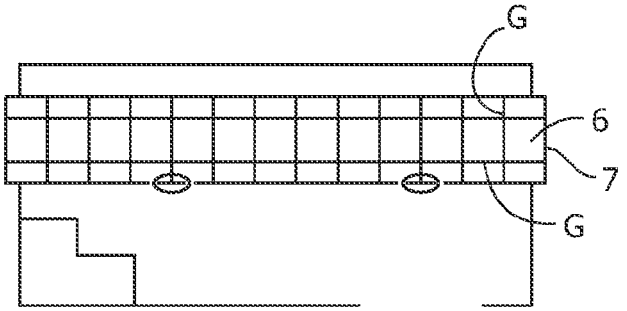

Step 2 (FIG. 2). Slightly unroll the layout grid liner 6 and trim the leading edge 7 the first grid mark G running across the liner using scissors. Measure the overall length of the room (Y) in the direction parallel to your two prominent walls. Unroll the layout grid 6 and, measuring from the leading edge 7, cut the first length of layout grid liner 6 at the grid mark past the measured distance Y.

Figure 3:
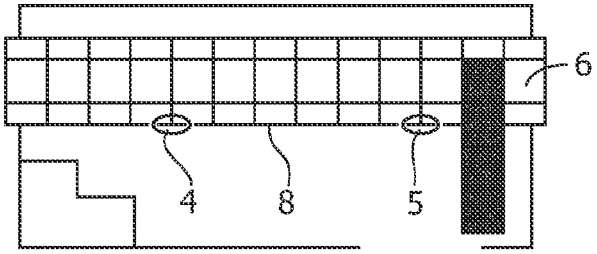

Step 3 (FIG. 3). Align one long edge 8 of the layout grid liner 6 with the midpoint marks 4 and 5 on the floor, allowing the ends to be flashed up the walls. Do a test layout of the tiles by positioning a tile (shown shaded in FIG. 3) on the layout grid lines and butting additional tile (shown shaded in FIG. 3) against each other, working towards one of the prominent walls. If the distance between the last full tile and the prominent wall is at least one-half the width of the tile, go directly to step 5.

Figure 4:
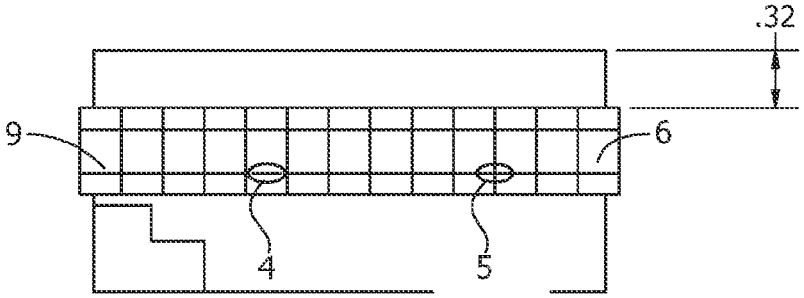

Step 4 (FIG. 4). If the distance between the last full tile and the prominent wall is less than one-half the width of the tile, then it is recommended that the layout grid liner 6 be shifted (toward the center of the room) by one-half the width of the tile so the tile at the prominent walls will be greater than one-half of a tile. This can be done by moving the original pencil marks or by shifting the layout grid liner 6 so that one of the long grid lines 9 fall on top of the original marks 4 and 5, as shown in FIG. 4. The prominent walls will now be balanced for equal-sized pieces larger than one-half tile.

Figure 5:
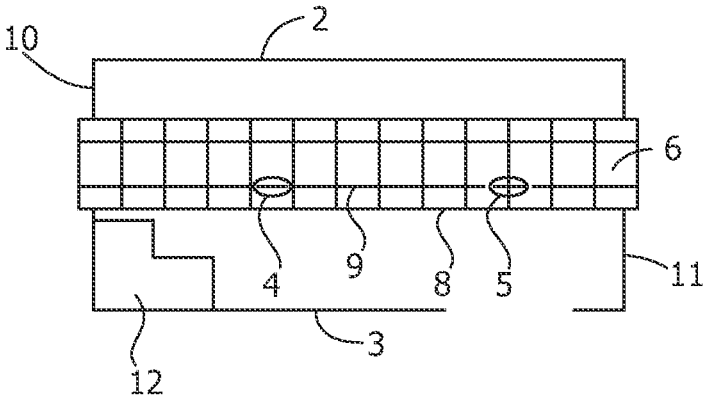

Step 5 (FIG. 5). Next, visually balance the grid to the remaining 'end' walls 9 and 10 or obstructions, such as cabinet 12. A small amount of the grid liner 6 should flash up the walls, so there will be good-sized pieces of tile at these walls. It is almost impossible to do this in every room, but try to avoid cut pieces at the perimeter areas that are less than 5 or 6 inches in width. Shift the layout grid liner 6 in the long direction to accomplish this but make sure the edge 8 of the grid liner 6, or one of the long grid lines 9, remains on top of the marks 4 and 5 as determined in the previous step to maintain balance at the prominent walls 2 and 3.

Figure 6:
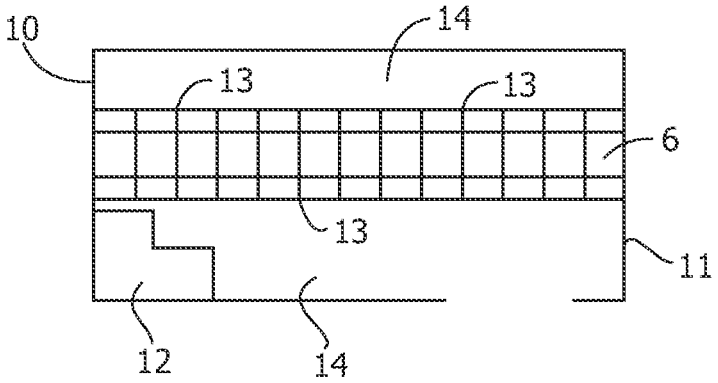

Step 6 (FIG. 6). Tape the "balanced" starting grid liner 6 to the subfloor 14 using common household transparent tape 13. Start near the middle of the grid liner 6, and gently push out any wrinkles or distortions. Tape the liner 6 to the subfloor 14 by placing a small amount of tape (about 1" piece) along both edges of the liner 6. Use tape 13 at every other grid line running across the sheet. The ends of the liner may now be cut with scissors or a utility knife to fit to the end walls 10 and 11 or cabinet 12. Do not fit too tight. Try to stay about ⅛" to ¼" away from the walls so there is no fullness. An easy way to mark the liner 6 for cutting is to press it into the corner where the floor and wall meet and mark it using a pen or pencil. It may then be folded back on itself and cut along the mark with scissors.

Figure 7:
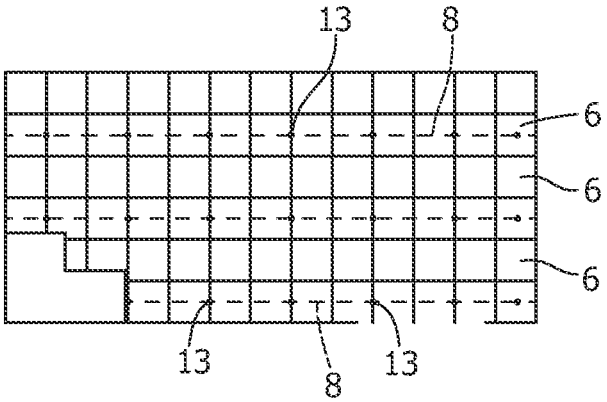

Step 7 (FIG. 7). Measure, cut and lay adjoining pieces of grid liner 6 on both sides of the starting piece that is taped to the subfloor 14. Carefully align the grid pattern so that the liner edges are butt together. Full widths of liners should all be running the same direction as the starting piece. When properly aligned and laying flat, use transparent tape 13 to fasten the adjoining edges of the new pieces of grid liner 6 to the preceding grid liner 6 that is already taped to the subfloor 14. If the liner is somewhat greater than a multiple of the tile width, overlap the edge portions width the grid marks aligned of overlapping. Tape the leading edges 8 of the new pieces of grid liner 6 to the subfloor 14 as done with the starting grid liner 6.

Cut and install subsequent pieces of the layout grid liner 6 to fill in the remainder of the room. Stay about ⅛" to ¼" away from the walls 2, 3, 10 and 11. There is no need to tape the perimeter edges of the liner 6 to the subfloor 14 at walls as long as the perimeter liners 6 are taped to the previous liner 6.

Installing The Tile With Adhesive Tabs

Figure 8:
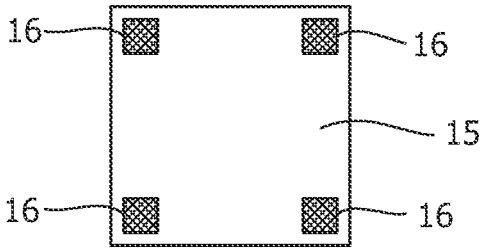
FIG. 8 is a bottom plan review showing the location of the adhesive tabs.

Step 8 (FIG. 8). In preparation for bonding the tile 15 to the liner, four adhesive tabs 16 must be placed on the back of each tile 15, one close to each of the corners. The adhesive tabs 16 are applied by pressing the sticky side of the tab 16 against the back of the tile 15 and rubbing the release liner side of the tab 16. Then, the release liner is simply peeled off. The tabs 16 should be placed about ¼" in from the actual edges of the tile 15.

Figure 9:
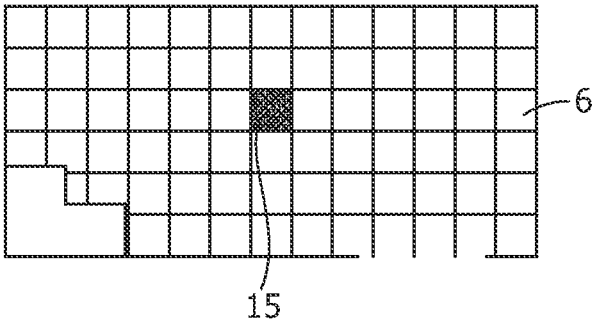
FIGS. 9 to 12 are schematic representations showing further installation steps of the present installation method.

Step 9 (FIG. 9). Install the first tile 15 inside the grid liner section closest to the center of the room. Line up the edges of the first tile as perfectly as possible within the grid.

Figure 10:
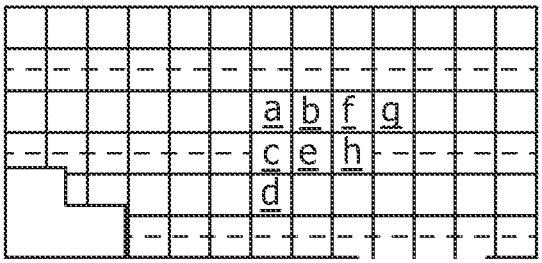

Step 10 (FIG. 10). Place adhesive tabs on successive tile and continue to install in "step fashion" (tile a, then tile b, then tile c, etc.), preferably in one quadrant, or one half of the room at a time. Butt the edges of each tile against the preceding tile.

Figure 11:
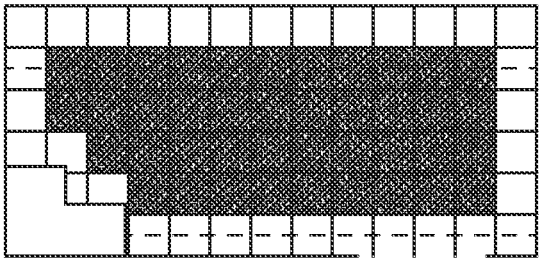

Step 11 (FIG. 11). Complete the remaining quadrants until all tiles are installed in the room. The installed tile are shown as shaded in FIG. 11.

Cutting Border Tile

Figure 12:
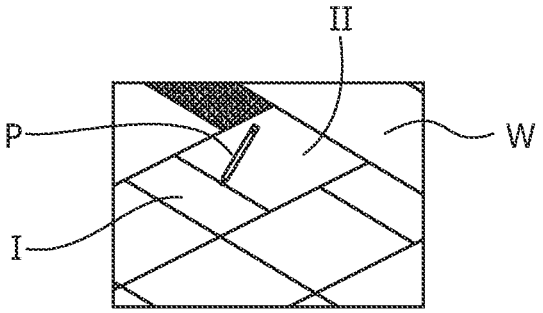

Step 12 (FIG. 12). For straight cuts at walls and cabinets, place a loose tile (I) face up exactly on top of the last full tile in that row. Place another full tile (II) on top of tile (I) with its edge against the wall (W). Using tile (II) as a guide, mark the face of tile (I) with a pencil (P).

Using a carpenter's square or a straight edge as a guide, carefully score the face of the tile I (about ⅓ thickness) along at the mark with a utility knife Bend at the score mark to snap the tile I into two pieces.

For irregular cuts, make a pattern out of craft paper or cardboard and transfer it to the tile. Score along the markings and snap small pieces off. Pliers or a coping saw are often useful in making more intricate cutouts for complicated fitting.

Tile should slip underneath the undercut door jambs for a neat fit. Do not fit tile too snug as some lifting or buckling off of the subfloor could develop.

Place adhesive tabs 16 at corners of cut pieces I and fasten in place on top of the grid liner 6. Keep cut edges towards the wall.

Finishing The Job

Replace baseboard and trim moldings. Replace furniture and appliances.

What is claimed is:

1. A floating flooring system overlying a subfloor comprising:

a plurality of floating liners having a grid pattern printed thereon and overlying the subfloor, each of the floating liners comprising:

a longitudinal axis and a transverse axis;

a first edge, a second edge, a third edge opposite the first edge, and a fourth edge opposite the second edge, the first and the third edges located on opposite sides of the longitudinal axis and extending between the second and fourth edges, the second and fourth edges located on opposite sides of the transverse axis;

the first edge intersecting the second edge at a first corner;

the fourth edge intersecting the first edge at a second corner; and wherein the first edge is a continuously linear edge that extends from the first corner to the second corner, wherein the floating liners are arranged atop the subfloor such that the first edges of the floating liners are adjacent to or overlap the third edge of an adjacent one of the floating liners;

a plurality of tiles overlying the floating liners and substantially aligned with the grid pattern; and wherein each tile has adhesive tabs for adhering the tiles to the floating liners, at least some of the tiles being adhered to two of the floating liners.

2. The floating flooring system of claim 1, wherein the width of the floating liners is a multiple of the width of the tiles and the first edge of the floating liners abut the third edge of adjacent floating liners.

3. The floating flooring system of claim 2, wherein the grid pattern includes a plurality of grid lines, the grid lines adjacent the continuously linear edge of the floating liners are spaced from the continuously linear edge by about one-half the width of the tiles.

4. The floating flooring system of claim 1, wherein the width of the floating liners is somewhat greater than a multiple of the width of the tiles and the first edge of the floating liners overlap the third edge of adjacent floating liners.

5. The floating flooring system of claim 4, wherein the grid pattern includes a plurality of grid lines, the grid lines adjacent the first edge of the floating liners are spaced from the first edge by somewhat greater than one-half the width of the tiles, the first edge of the floating liners being marked whereby when the third edge of the adjacent adjacent floating liners are overlapped with the marks of one of the adjacent floating liners overlying the mark of another one of the adjacent floating liners, the distance between the grid lines adjacent the first edge equals the width of the tiles.

6. The floating flooring system of claim 1, wherein the floating liners are transparent or translucent.

7. The floating flooring system of claim 1, wherein the grid pattern matches the size and shape of the tiles.

8. The floating flooring system of claim 1, wherein the floating liners are made from a material selected from the group consisting of rigid vinyl film, a glass mat, amorphous polyethylene terephthalate, and Mylar.

9. The floating flooring system of claim 1, wherein the tiles have an Olsen stiffness of no greater than 10 in-lb.

10. The floating flooring system of claim 1, wherein the tiles are resilient vinyl tiles.

11. The floating flooring system of claim 1, wherein the tiles have beveled edges.

12. The floating flooring system of claim 1, further comprising a seam sealer applied to seams between adjacent tiles.

13. The floating flooring system of claim 1, wherein the floating liners, tiles and adhesive are compatible, whereby the floating liners, tiles and adhesive can be recycled into tile.

14. A floating flooring system overlying a subfloor comprising:

a plurality of floating rigid vinyl continuous film liners overlying the subfloor, each of the floating liners comprising:

a first edge, a second edge, a third edge opposite the first edge, and a fourth edge opposite the second edge;

the first edge intersecting the second edge at a first corner;

the fourth edge intersecting the first edge at a second corner; and wherein the first edge is a continuously linear longitudinal edge that extends from the first corner to the second corner, wherein the floating liners are arranged atop the subfloor such that the first longitudinal edge of the floating liners are adjacent to or overlap the third edge of an adjacent one of the floating liners;

a plurality of resilient vinyl tiles overlying the floating liners; and wherein each tile has adhesive tabs for adhering the tiles to the floating liners, at least some of the tiles being adhered to two of the floating liners.

15. The system of claim 1, wherein the plurality of tiles are adhered only to the plurality of floating liners.

16. The system of claim 14, wherein the plurality of tiles are adhered only to the plurality of floating liners.

17. The system of claim 1, wherein the first edge, the second edge, the third edge, and the fourth edge form a perimeter of the floating liner.

18. The system of claim 1, wherein the first edge, the second edge, the third edge, and the fourth edge form a perimeter of the floating liner.

* * * * *